US010711726B2

(12) United States Patent
Ulstad et al.

(10) Patent No.: US 10,711,726 B2
(45) Date of Patent: Jul. 14, 2020

(54) FUEL DELIVERY SYSTEM

(71) Applicant: Caterpillar Inc., Peoria, IL (US)

(72) Inventors: James Steven Ulstad, Edwards, IL (US); Ye Tian, Bloomington, IL (US); Purvarag S. Shah, Dunlap, IL (US); Kranti Kumar Nellutla, Normal, IL (US); Sasidhar Rayasam, Peoria, IL (US); Brian P. Brennan, Steger, IL (US); Purna Chandra Sekhar Mokkarala, Chennai (IN); Mohammed Rafi H, Chennai (IN); Gregory Lance Armstrong, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 249 days.

(21) Appl. No.: 15/803,049

(22) Filed: Nov. 3, 2017

(65) Prior Publication Data

US 2019/0136787 A1 May 9, 2019

(51) Int. Cl.
*F02D 41/38* (2006.01)
*F02D 19/02* (2006.01)

(52) U.S. Cl.
CPC ..... *F02D 41/3863* (2013.01); *F02D 41/3845* (2013.01); *F02D 19/022* (2013.01); *F02D 2200/0602* (2013.01)

(58) Field of Classification Search
CPC ..... F02D 41/3863; F02D 41/3845; F02D 2200/0602
USPC ..... 123/456
See application file for complete search history.

(56) References Cited

U.S. PATENT DOCUMENTS

| | | | | |
|---|---|---|---|---|
| 5,535,621 | A | 7/1996 | Glidewell et al. | |
| 7,472,690 | B2 | 1/2009 | Takayanagi et al. | |
| 8,091,531 | B2 | 1/2012 | Lucido et al. | |
| 8,281,768 | B2 | 10/2012 | Cinpinski et al. | |
| 8,800,355 | B2 * | 8/2014 | Toyoshima | F02M 63/025 73/114.43 |
| 9,394,845 | B2 | 7/2016 | Stack et al. | |
| 9,458,786 | B2 * | 10/2016 | Dolker | F02D 41/222 |
| 9,546,628 | B2 * | 1/2017 | Sanborn | F02M 39/00 |
| 2010/0250095 | A1 * | 9/2010 | Yamada | F02D 41/3809 701/103 |
| 2010/0250097 | A1 * | 9/2010 | Yamada | F02D 41/401 701/103 |
| 2012/0080010 | A1 * | 4/2012 | Nistler | F02D 41/3863 123/456 |

(Continued)

*Primary Examiner* — David Hamaoui
*Assistant Examiner* — John D Bailey
(74) *Attorney, Agent, or Firm* — Miller, Matthias & Hull

(57) ABSTRACT

A fuel delivery system for an engine is provided. The fuel delivery system includes a fuel rail, a pressure sensor, a relief valve, and a controller. The controller is configured to receive a signal indicative of a fuel rail pressure, identify exceeding of the fuel rail pressure beyond a first threshold, identify the fuel rail pressure drop below a second threshold, and initiate a counter for a first predefined amount of time accordingly. The controller is also configured to identify if the fuel rail pressure drops below a third threshold within the first predefined amount of time, and identify if the fuel rail pressure remains below the third threshold for at least a second predefined amount of time. The controller is further configured to determine an open status of the relief valve based, at least in part, on the identification.

20 Claims, 3 Drawing Sheets

(56) References Cited

U.S. PATENT DOCUMENTS

| | | | | |
|---|---|---|---|---|
| 2013/0199499 | A1* | 8/2013 | Pursifull | F02M 21/0239 123/456 |
| 2017/0248096 | A1* | 8/2017 | Zeng | F02D 41/3863 |
| 2018/0135551 | A1* | 5/2018 | Trzeciak | F02D 41/3082 |
| 2018/0195458 | A1* | 7/2018 | Puckett | F02D 41/3082 |

* cited by examiner

FUEL DELIVERY SYSTEM

TECHNICAL FIELD

The present disclosure relates to a fuel delivery system. More particularly, the present disclosure relates to the fuel delivery system associated with an internal combustion engine.

BACKGROUND

An internal combustion engine generally employs a fuel delivery system for delivering pressurized fuel into one or more cylinders thereof for combustion purposes. The fuel delivery system may include a fuel rail for storing and delivering the pressurized fuel into the cylinders. In order to limit over pressurization of the fuel rail, a pressure relief valve may be provided thereon to relieve excess pressure therefrom and, thus, limit damage to the fuel rail.

In many situations, the pressure relief valve may be mechanically operated. As a result, it may be difficult to detect an open event of the pressure relief valve. As the pressure relief valve may open, the pressure within the fuel rail may drop drastically resulting in undesired reduced performance of the engine. In some situations, opening of the pressure relief valve for an extended period of time may lead to premature erosion of components of the pressure relief valve, such as a valve element, seals, and so on. This may, in turn, lead to inaccurate operation, reduced safety of the fuel rail, reduced life of the pressure relief valve, increased replacement/service cost, and so on.

In some situations, opening of the pressure relief valve for the extended period of time may result in over working of the components of the fuel delivery system, such as a fuel pump. Over working of the fuel pump may increase a parasitic load on the engine, reduce fuel efficiency, reduce engine efficiency, and so on. Also, over working of the components of the fuel delivery system may further result in premature damage to the fuel delivery system, in turn, resulting in increased system cost, operational cost, machine downtime, service cost, labor cost, and so on. Hence, there is a need for an improved fuel delivery system.

U.S. Pat. No. 9,394,845 descries a first computer-implemented diagnostic method adapted to operate in response to an imminent deceleration fuel cutoff (DFCO) event. A second computer-implemented diagnostic method is adapted to operate during an engine shutdown. Both diagnostic methods are configured to control fuel injectors and a fuel pump in order to change a fuel rail pressure from a desired minimum to a desired maximum. Measurements from a fuel rail pressure sensor at these endpoints is then used in order to detect a fault of the fuel rail pressure sensor.

SUMMARY OF THE DISCLOSURE

In an aspect of the present disclosure, a fuel delivery system for an engine is provided. The fuel delivery system includes a fuel rail adapted to receive a pressurized fuel therein. The fuel delivery system includes a pressure sensor coupled to the fuel rail. The rail delivery system also includes a relief valve fluidly coupled to the fuel rail. The fuel delivery system further includes a controller communicably coupled to the pressure sensor and the engine. The controller is configured to receive a signal indicative of a fuel rail pressure from the pressure sensor. The controller is configured to identify exceeding of the fuel rail pressure beyond a first threshold. The controller is configured to identity the fuel rail pressure drop below a second threshold. The controller is configured to initiate a counter for a first predefined amount of time based, at least in part, on the fuel rail pressure drop below the second threshold. The controller is configured to identify if the fuel rail pressure drops below a third threshold within the first predefined amount of time. The controller is also configured to identify if the fuel rail pressure remains below the third threshold for at least a second predefined amount of time. The controller is further configured to determine an open status of the relief valve based, at least in part, on the identification.

In another aspect of the present disclosure, an engine is provided. The engine includes an engine block. The engine includes a cylinder head mounted on the engine block. The engine also includes a plurality of cylinders provided within the engine block. The engine further includes a fuel delivery system adapted to deliver a pressurized fluid into each of the plurality of cylinders. The fuel delivery system includes a fuel rail adapted to receive the pressurized fuel therein. The fuel delivery system includes a pressure sensor coupled to the fuel rail. The fuel delivery system also includes a relief valve fluidly coupled to the fuel rail. The delivery system further includes a controller communicably coupled to the pressure sensor and the engine. The controller is configured to receive a signal indicative of a fuel rail pressure from the pressure sensor. The controller is configured to identify exceeding of the fuel rail pressure beyond a first threshold. The controller is configured to identify the fuel rail pressure drop below a second threshold. The controller is configured to initiate a counter for a first predefined amount of time based, at least in part, on the fuel rail pressure drop below the second threshold. The controller is configured to identify if the fuel rail pressure drops below a third threshold within the first predefined amount of time. The controller is also configured to identify if the fuel rail pressure remains below the third threshold for at least a second predefined amount of time. The controller is further configured to determine an open status of the relief valve based, at least in part, on the identification.

In yet another aspect of the present disclosure, a method for determining an operational status of a pressure relief valve associated with a fuel delivery system of an engine is provided. The method includes receiving a signal indicative of a fuel rail pressure associated with a fuel rail. The method includes identifying exceeding of the fuel rail pressure beyond a first threshold. The method includes identifying the fuel rail pressure drop below a second threshold. The method includes initiating a counter for a first predefined amount of time based, at least in part, on the fuel rail pressure drop below the second threshold. The method includes identifying if the fuel rail pressure drops below a third threshold within the first predefined amount of time. The method also includes identifying if the fuel rail pressure remains below the third threshold for at least a second predefined amount of time. The method further includes determining an open status of the pressure relief valve based, at least in part, on the identification.

Other features and aspects of this disclosure will be apparent from the following description and the accompanying drawings.

DETAILED DESCRIPTION

Figure 1:
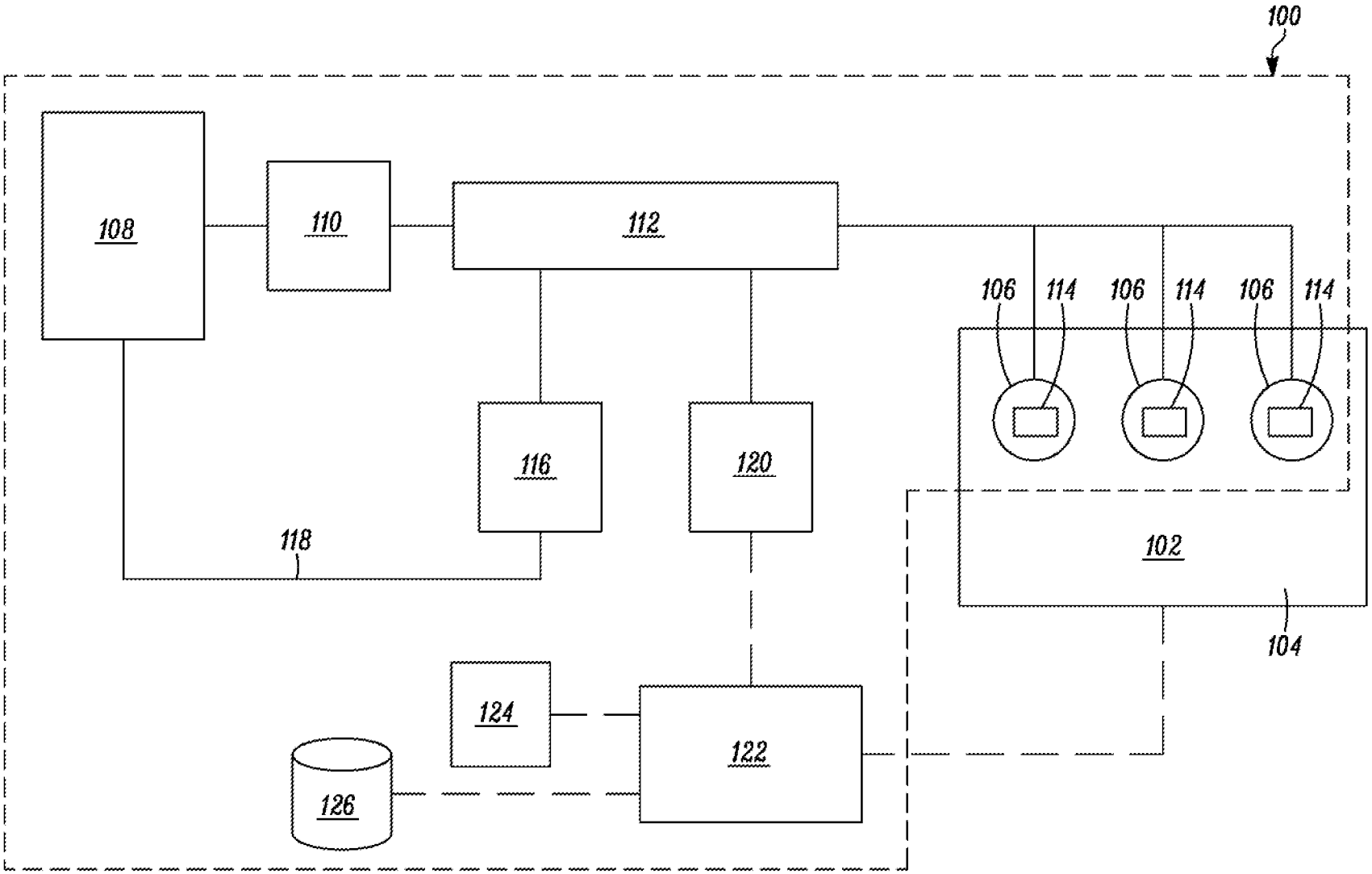
FIG. 1 is a schematic representation of an exemplary fuel delivery system for an engine, according to one embodiment of the present disclosure.

Wherever possible, the same reference numbers will be used throughout the drawings to refer to the same or the like parts. Referring to FIG. 1, an exemplary fuel delivery system 100 associated with an engine 102 is illustrated. The engine 102 is an internal combustion engine powered by any fuel known in the art, such as natural gas, diesel, gasoline, and/or a combination thereof. In some embodiments, the engine 102 may be associated with a machine (not shown) including, but not limited to a locomotive, a marine vessel, a land vehicle, and a power generator, among others. The engine 102 and/or the machine may be employed in any industry including, but not limited to construction, agriculture, forestry, mining, transportation, waste management, aviation, marine, material handling, and power generation.

The engine 102 may include an engine block 104. The engine block 104 includes one or more cylinders 106 provided therein. The cylinders 106 may be arranged in any configuration including, but not limited to an inline, radial, and "V", among others. Each of the cylinders 106 is adapted to receive a piston (not shown) therein. The engine 102 may also include a cylinder head (not shown) mounted on the engine block 104. The cylinder head may house one or more components (not shown) of the engine 102 including, but not limited to an intake manifold, an exhaust manifold, a valve train, and sensors, among others. Additionally, the engine 102 may include various other components and/or systems (not shown) including, but not limited to a crankcase, an air delivery system, a cooling system, a lubrication system, a turbocharger, an exhaust gas recirculation system, an exhaust aftertreatment system, and peripheries, among others.

The fuel delivery system 100 will be hereinafter interchangeably referred to as "the system 100". The system 100 is adapted to supply the fuel to the engine 102. The system 100 includes a fuel tank 108. The fuel tank 108 is adapted to store and deliver the fuel therefrom to the engine 102. The fuel tank 108 may be any tank known in the art adapted to store the fuel therein. The system 100 includes a fuel pump 110 fluidly coupled to the fuel tank 108. The fuel pump 110 is adapted to receive the fuel from the fuel tank 108 and pressurize the fuel to a higher pressure. The fuel pump 110 may be any pump known in the art, including but not limited to, a piston pump such as a fixed displacement, a variable displacement, an over center, and so on; a gear pump, a vane pump, and a gerotor pump.

The system 100 includes a fuel rail 112 fluidly coupled to the fuel pump 110. The fuel rail 112 is adapted to receive the pressurized fuel from the fuel pump 110. The fuel rail 112 may be any high pressure distribution chamber known in the art used for fuel systems. The system 100 includes one or more injectors 114 fluidly coupled to the fuel rail 112. The injectors 114 are fluidly coupled to the one or more cylinders 106 of the engine 102 respectively. The injectors 114 are adapted to inject the pressurized fuel into the respective cylinders 106 of the engine 102 using any fuel injection method known in the art, such as port injection, direct injection, and so on. The injector 114 may be any fuel injector known in the art, such as an electronically operated fuel injector, a hydraulically operated fuel injector, and so on.

The system 100 includes a relief valve 116 fluidly coupled to the fuel rail 112. The relief valve 116 is adapted to relieve excess pressure beyond a threshold within the fuel rail 112. The relief valve 116 may be further fluidly coupled to the fuel tank 108 through a bypass line 118. Accordingly, during an excess pressure condition within the fuel rail 112, the relief valve 116 may open in order to direct excess pressurized fuel to the fuel tank 108 through the bypass line 118. In a situation, when the fuel rail pressure may drop below the threshold, the relief valve 116 may close in order to limit flow of the pressurized fuel back to the fuel tank 108 and allow increase of the fuel rail pressure. The relief valve 116 may be any mechanically operated pressure relief valve known in the art, such as a spring type relief valve, a dead weight type relief valve, and so on.

The system 100 also includes a pressure sensor 120 coupled to the fuel rail 112. The pressure sensor 120 is adapted to generate a signal indicative of the fuel rail pressure associated with the fuel rail 112. The pressure sensor 120 may be any pressure sensor known in the art, such as a strain gauge type pressure sensor, a capacitive type pressure sensor, an electromagnetic type pressure sensor, a piezoelectric type pressure sensor, an optical type pressure sensor, and so on.

The system 100 further includes a controller 122. The controller 122 may be any control unit known in the art configured to perform various functions of the system 100. In one embodiment, the controller 122 may be a dedicated control unit configured to perform functions related to the system 100. In another embodiment, the controller 122 may be a Machine Control Unit (MCU) associated with the machine, an Engine Control Unit (ECU) associated with the engine 102, and so on configured to perform functions related to the system 100.

Figure 2:
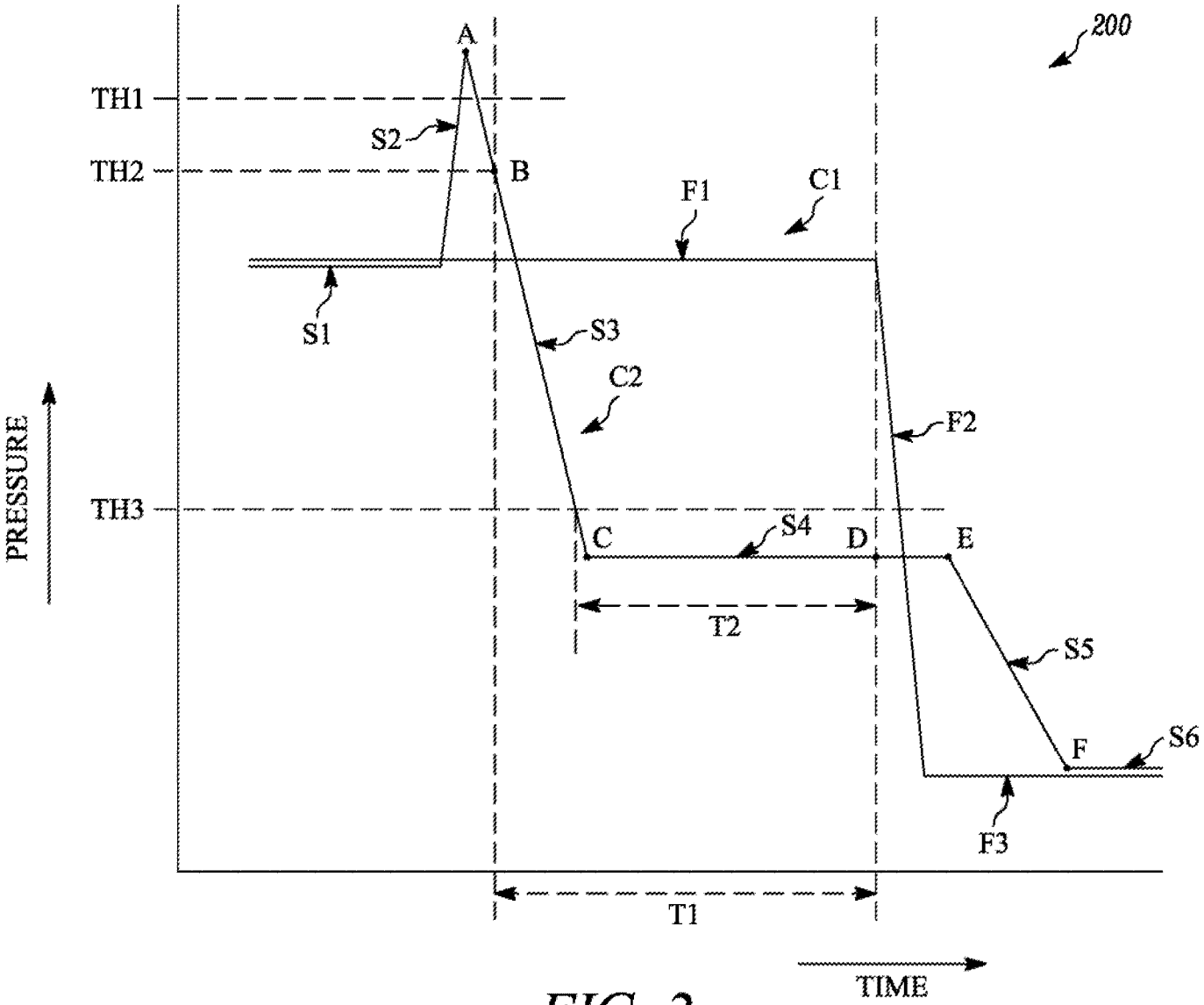
FIG. 2 is an exemplary graphical representation of working of the fuel delivery system of FIG. 1, according to one embodiment of the present disclosure.

The controller 122 is communicably coupled to the pressure sensor 120 and the engine 102. Accordingly, the controller 122 is configured to receive the signal indicative of the fuel rail pressure from the pressure sensor 120. Referring to FIG. 2, a graph 200 illustrates an exemplary graphical representation of working of the system 100. More specifically, the graph 200 illustrates working conditions of the fuel rail 112 in relation to a pressure variation therein during operation of the engine 102.

The graph 200 includes a first curve "C1" find a second curve "C2". The first curve "C1" illustrates an exemplary desired working pressure condition within the fuel rail 112. For example, a segment "F1" of the first curve "C1" denotes a constant pressure condition within the fuel rail 112 during a closed status of the relief valve 116 as may be commanded during normal operating conditions. The constant pressure condition within the fuel rail 112 may be maintained during normal working condition of the engine 102, the fuel pump 110, the injectors 114, and so on.

A segment "F2" of the first curve "C1" denotes a reducing pressure condition within the fuel rail 112 during an open status of the relief valve 116. The reducing pressure condition within the fuel rail 112 may be a result of variation in one or more parameters including, but not limited to, an increase in a fueling rate through the one or more injectors 114, increase in a speed of the engine 102, increase in a power output of the engine 102, increase in a load on the engine 102, reduction in a speed of the fuel pump 110 or malfunction thereof, and so on.

A segment "F3" of the first curve "C1" denotes a constant low pressure condition within the fuel rail 112 during the closed status of the relief valve 116. The constant low pressure condition within the fuel rail 112 may be a result of variation in one or more parameters including, but not limited to, a derating, idling or shutdown of the engine 102, reduction in the speed of the fuel pump 110 or malfunction thereof, and so on.

The second curve "C2" illustrates an exemplary actual working pressure condition within the fuel rail 112. For example, a segment "S1" denotes the constant pressure condition within the fuel rail 112 during the closed status of the relief valve 116 as described with relation to the segment "F1" of the first curve "C1". The constant pressure condition within the fuel rail 112 may be maintained during normal working condition of the engine 102, the fuel pump 110, the injectors 114, and so on.

In some situations, the fuel rail pressure may increase rapidly resulting in a pressure spike as denoted by a segment "S2". The pressure spike may be created due to a continuous operation of the fuel pump 110, a malfunction of the fuel pump 110, and so on. As a result, the fuel rail pressure may exceed a first threshold "TH1" as denoted by a point "A". The first threshold "TH1" may be related to a maximum allowable working pressure of the fuel rail 112. Accordingly, the controller 122 is configured to identity exceeding of the fuel rail pressure beyond the first threshold "TH1". It should be noted that actual values of the first threshold "TH1" may vary based on application requirements.

As the fuel rail pressure may exceed the first threshold "TH1", the relief valve 116 may open at the point "A". Accordingly, the point "A" may be a blow off or relief threshold of the relief valve 116. As the relief valve 116 may open, the fuel rail pressure may begin dropping rapidly, as denoted by a segment "S3". More specifically, the relief valve 116 may direct excess fuel from the fuel rail 112 back to the fuel tank 108 through the bypass line 118.

As the fuel rail pressure may drop and reach a second threshold "TH2" at a point "B", the controller 122 is configured to identify the fuel rail pressure drop below the second threshold "TH2". In the illustrated embodiment, the second threshold "TH2" is a hysteresis threshold based on the first threshold "TH1". In other embodiments, the second threshold "TH2" may be a fraction of the first threshold "TH1" and may vary based on application requirements. For example, the second threshold "TH2" may be a percentage of the first threshold "TH1", such as 3%, 4%, 5%, and so on of the first threshold "TH1". Also, the second threshold "TH2" is lower than the first threshold "TH1". It should be noted that actual values of the second threshold "TH2" may vary based on application requirements.

Further, as the fuel rail pressure may reach or drop below the point "B", the controller 122 is configured to initiate a counter for a first predefined amount of time "T1" at the point "B". The first predefined amount of time "T1" may be a preset timer window configured to identify one or more parameters within the preset timer window in order to determine a predefined function of the controller 122. It should be noted that actual values of the first predefined amount of time "T1" may vary based on application requirements.

Further, due to the opening of the relief valve 116, the fuel rail pressure may continue to drop as denoted by the segment "S3" and may drop below a third threshold "TH3". Accordingly, the controller 122 is configured to identify if the fuel rail pressure drops below the third threshold "TH3" within the first predefined amount of time "T1". The third threshold "TH3" may be a minimum operable working pressure of the fuel rail 112. Also, the third threshold "TH3" is lower than the second threshold "TH2". It should be noted that actual values of the third threshold "TH3" may vary based on application requirements.

As the fuel rail pressure may drop below the third threshold "TH3" and reach a point "C", the fuel rail pressure may remain approximately constant due to the opening of the relief valve 116 as denoted by a segment "S4". More specifically, the fuel rail pressure may continue to remain constant until closing of the relief valve 116. Accordingly, the controller 122 is configured to identify if the fuel rail pressure remains below the third threshold "TH3" for at least a second predefined amount of time "T2". The second predefined amount of time "T2" may be a fraction of the first predefined amount of time "T1". For example, the second predefined amount of time "T2" may be a percentage of the first predefined amount of time "T1", such as 30%, 40%, 50%, and so on of the first predefined amount of time "T1". It should be noted that actual values of the second predefined amount of time "T2" may vary based on application requirements.

Further, at end of the first predefined amount of time "T1", such as at a point "D", the controller 122 is configured to determine the open status of the relief valve 116 based, at least in part, on the identification. More specifically, as the controller 122 identifies the pressure conditions within the fuel rail 112 corresponding to the point "A", the point "B", the point "C", and the point "D", and the first and second predefined amount of time "T1", "T2" conditions at the point "B", the point "C", and the point "D", the controller 122 is configured to determine the open status of the relief valve 116.

In one embodiment, the controller 122 may be further configured to limit an operational parameter associated with the engine 102 based on the determination of the open status of the relief valve 116. For example, in one embodiment, the controller 122 may be configured to derate the engine 102 in order to reduce the speed of the engine 102, such as up to an idling speed. In other embodiment, the controller 122 may be configured to derate the engine 102 in order to reduce the power output of the engine 102, such as to overcome frictional losses, parasitic load, and so on.

In another embodiment, the controller 122 may be configured to reduce the load on the engine 102, such as decoupling the engine 102 though a transmission system (not shown). In yet another embodiment, the controller 122 may be configured to reduce the speed of the fuel pump 110 in order to reduce the fuel rail pressure. In such a situation, the fuel rail pressure may drop below a point "E" as denoted by a segment "S5" up to a low pressure condition at a point "F" as denoted by a segment "S6". The segment "S6" may approximately correspond to the segment "F3" of the first curve "C1". At the low pressure condition, the fuel rail pressure may correspond to a closing pressure of the relief valve 116 in order to switch the relief valve 116 back to the closed status.

In another embodiment, the controller 122 may be further configured to identify a number of instances of the open status of the relief valve 116. Additionally, the controller 122 may be configured to determine a maintenance interval of the relief valve 116 based on the number of instances exceeding a predefined number of cycles (not shown). The predefined number of cycles may be maximum allowable number of instances of opening and/or closing cycles of the relief valve 116, such as fifty cycles, sixty cycles, and so on. More specifically, based on the number of opening/closing cycles of the relief valve 116 exceeding the predefined number of cycles, the controller 122 may indicate the maintenance interval or replacement schedule of the relief valve 116 to an operator.

In yet another embodiment, the controller 122 may indicate the open status of the relief valve 116 to the operator. More specifically, the controller 122 may indicate the maintenance interval/replacement schedule and/or the open status of the relief valve 116 to the operator through an operator console 124 (shown in FIG. 1). The operator console 124 may include any audio device and/or visual device known in the art, such as a speaker unit, a display unit, a lamp, and so on. Accordingly, the indication may be provided using one or more of an alarm, a warning beep, alphanumerical characters, display of warning icons, and so on.

It should be noted that each of the first curve "C1", the second curve "C2", the first threshold "TH1", the second threshold "TH2", the third threshold "TH3", the point "A", the point "B", the point "C", the point "D", the point "E", the point "F", the first predefined amount of time "T1", and the second predefined amount of the time "T2" may be stored in a memory (not shown) of the controller 122 or a database 126 (shown in FIG. 1) communicably coupled to the controller 122. For example, in one embodiment, one or more of the first curve "C1", the second curve "C2", the first threshold "TH1", the second threshold "TH2", the third threshold "TH3", the point "A", the point "B", the point "C", the point "D", the point "E", the point "F", the first predefined amount of time "T1", and/or the second predefined amount of time "T2" may be stored as a dataset in the memory of the controller 122 or the database 126 communicably coupled to the controller 122. In another embodiment, one or more of the first curve "C1", the second curve "C2", the first threshold "TH1", the second threshold "TH2", the third threshold "TH3", the point "A", the point "B", the point "C", the point "D", the point "E", the first "F", the first predefined amount of time "T1", and/or the second predefined amount of time "T2" may be derived based on a mathematical expression stored in the memory of the controller 122 or the database 126 communicably coupled to the controller 122.

INDUSTRIAL APPLICABILITY

Figure 3:
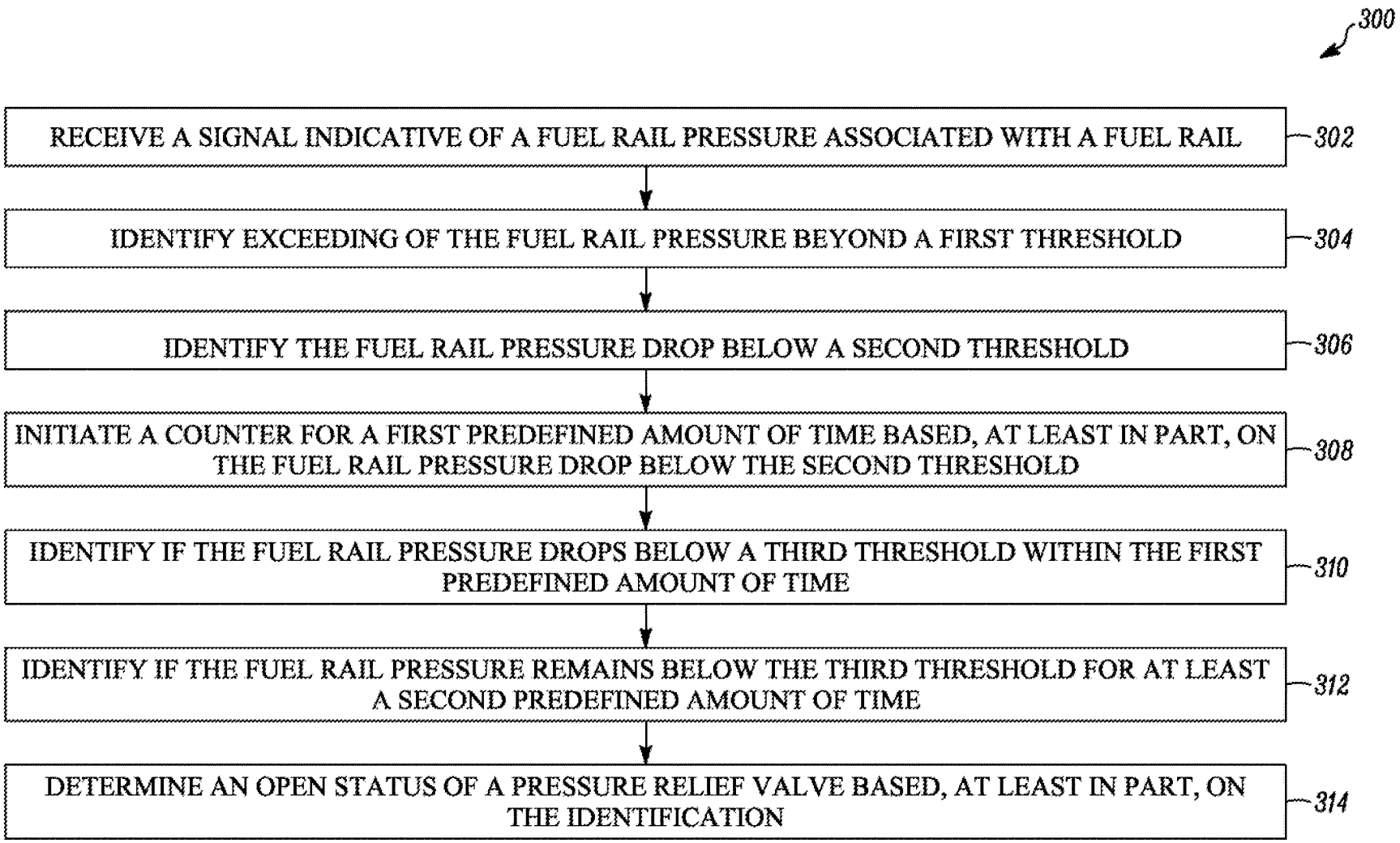
FIG. 3 is a flowchart illustrating a method for determining an operational status of a relief valve associated with the fuel delivery system of FIG. 1, according to one embodiment of the present disclosure.

The present disclosure relates to a method 300 for determining the operational status of the pressure relief valve 116 associated with the fuel delivery system 100 of the engine 102. Referring to FIG. 3, a flowchart of the method 300 is illustrated. At step 302, the controller 122 receives the signal indicative of the fuel rail pressure from the pressure sensor 120. At step 304, the controller 122 identifies exceeding of the fuel rail pressure beyond the first threshold "TH1".

More specifically, the controller 122 identifies the point "A" on the first curve "C1" when the fuel rail pressure exceeds beyond the first threshold "TH1". The first threshold "TH1" may be the maximum allowable working pressure of the fuel rail 112. At step 306, the controller 122 identifies the fuel rail pressure drop below the second threshold "TH2". More specifically, the controller 122 identifies the point "B" on the first curve "C1" when the fuel rail pressure drops below the second threshold "TH2".

The second threshold "TH2" may be the hysteresis threshold based on the first threshold "TH1", such that the second threshold "TH2" may be the fraction of the first threshold "TH1". Also, the second threshold "TH2" is lower than the first threshold "TH1". At step 308, the controller 122 initiates the counter for the first predefined amount of time "T1" based, at least in part, on the fuel rail pressure drop below the second threshold "TH2". More specifically, the controller 122 initiates the first predefined amount of time "T1" at the point "B".

At step 310, the controller 122 identifies if the fuel rail pressure drops below the third threshold "TH3" within the first predefined amount of time "T1". More specifically, the controller 122 identifies the point "C" on the first curve "C1" being below the third threshold "TH3" within the first predefined amount of time "T1". The third threshold "TH3" is lower than the second threshold "TH2". Also, the third threshold "TH3" may be the minimum operable working pressure of the fuel rail 112. Further, the second predefined amount of time "T2" may be the fraction of the first predefined amount of time "T1".

At step 312, the controller 122 identifies if the fuel rail pressure remains below the third threshold "TH3" for at least the second predefined amount of time "T2". More specifically, the controller 122 identifies if a duration of the segment "S4" is equal to or greater than the second predefined amount of time "T2". At step 314, the controller 122 determines the open status of the pressure relief valve 116 based on the determination. For example, when the duration of the segment "S4" may be equal to or greater than the second predefined amount of time "T2", the controller 122 determines the open status of the pressure relief valve 116 at the end of the first predefined amount of time "T1" at the point "D".

Based on the determination, in one embodiment, the controller 122 may be further configured to limit the one or more operational parameter associated with the engine 102 including, but not limited to, the speed thereof, the power output thereof, and the load thereon. In another embodiment, the controller 122 may be configured to reduce the operational parameter of the fuel pump 110, such as the speed thereof. In yet another embodiment, the controller 122 may be further configured to identify the number of instances of the open status of the relief valve 116.

Additionally, the controller 122 may be configured to determine the maintenance interval of the relief valve 116 based on the number of instances exceeding the predefined number of cycles. In some embodiments, the controller 122 may indicate the maintenance interval replacement schedule and/or the open status of the relief valve 116 to the operator through the operator console 124 using one or more of the alarm, the warning beep, the alphanumerical characters, the display of warning icons, and so on.

The determination of the open status of the relief valve 116 enables further control of the operational parameters of the engine 102 in order to limit damage to the engine 102, the system 100, and/or the relief valve 116. On determination of the open status of the relief valve 116, the system 100 may command the fuel pump 110 to lower an output thereof. This may reduce the fuel rail pressure to switch the relief valve 116 back to the closed status at the point "F". Accordingly, premature damage to the relief valve 116 due to erosion may be limited, in turn, increasing a working life thereof. Also, the determination of the maintenance interval of the relief valve 116 may provide regular maintenance or replacement of the relief valve 116 in order to limit operation of the system 100 using a faulty valve.

The fuel delivery system 100 provides a simple, efficient, and cost effective method for determining the operational status of the mechanically operated pressure relief valve 116. The system 100 employs components generally provided within the engine 102, such as the pressure sensor 120 and/or the controller 122, in turn, reducing an overall cost of the system 100. Also, the system 100 may be retrofitted in any engine system with little or no modification to the existing system.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A fuel delivery system for an engine, the fuel delivery system comprising:
- a fuel rail adapted to receive a pressurized fuel therein;
- a pressure sensor coupled to the fuel rail;
- a relief valve fluidly coupled to the fuel rail; and
- a controller communicably coupled to the pressure sensor and the engine, the controller configured to:
  - receive a signal indicative of a fuel rail pressure from the pressure sensor;
  - identify exceeding of the fuel rail pressure beyond a first threshold;
  - identify the fuel rail pressure drop below a second threshold;
  - initiate a counter for a first predefined amount of time based, at least in part, on the fuel rail pressure drop below the second threshold;
  - identify if the fuel rail pressure drops below a third threshold within the first predefined amount of time;
  - identify if the fuel rail pressure remains below the third threshold for at least a second predefined amount of time;
  - determine an open status and a closed status of the relief valve based, at least in part, on the identification;
  - identify a number of cycles of the open and closed status of the relief valve; and
  - determine a maintenance interval of the relief valve, based at least in part, on the number of cycles exceeding a predefined threshold of cycles.

2. The fuel delivery system of claim 1, whereat the controller is further configured to limit at least one of a speed, a power output, and a load on the engine based, at least in part, on the determination.

3. The fuel delivery system of claim 1, wherein the controller is further configured to:
- indicate at least one of the maintenance interval or the open status of the relief valve to an operator as one or more of an alarm, alphanumerical characters, or an icon.

4. The fuel delivery system of claim 1, wherein the second threshold is a hysteresis threshold based, at least in part, on the first threshold.

5. The fuel delivery system of claim 1, wherein;
- the second threshold is lower than the first threshold; and
- the third threshold is lower than the second threshold.

6. The fuel delivery system of claim 1, wherein the second predefined amount of time is a fraction of the first predefined amount of time.

7. The fuel delivery system of claim 1, wherein the relief valve is a mechanically operated pressure relief valve.

8. The fuel system of claim 1, wherein the fuel is at least one of diesel fuel, gasoline fuel, and Liquefied Natural Gas (LNG) fuel.

9. An engine comprising:
- an engine block;
- a cylinder head mounted on the engine block;
- a plurality of cylinders provided within the engine block; and
- a fuel delivery system adapted to deliver a pressurized fluid into each of the plurality of cylinders, the fuel delivery system comprising:
- a fuel rail adapted to receive the pressurized fuel therein;
- a pressure sensor coupled to the fuel rail;
- a relief valve fluidly coupled to the fuel rail; and
- a controller communicably coupled to the pressure sensor and the engine, the controller configured to:
  - receive a signal indicative of a fuel rail pressure from the pressure sensor;
  - identify exceeding of the fuel rail pressure beyond a first threshold;
  - identify the fuel, rail pressure drop below a second threshold;
  - initiate a counter for a first predefined amount of time based, at least in part, on the fuel rail pressure drop below the second threshold;
  - identify if the fuel rail pressure drops below a third threshold within the first predefined amount of time;
  - identify if the fuel rail pressure remains below the third threshold for at least a second predefined amount of time;
  - determine an open status and a closed status of the relief valve based, at least in part, on the identification,
  - identify a number of cycles of the open and closed status of the relief valve; and
  - determine a maintenance interval of the relief valve, based at least in part, on the number of cycles exceeding a predefined threshold of cycles.

10. The engine of claim 9, wherein the controller is further configured to limit at least one of a speed, a power output, and a load on the engine based, at, least in part, on the determination.

11. The engine of claim 9, wherein the controller is further configured to:
- indicate at least one of the maintenance interval or the open status of the relief valve to an operator as one or more of an alarm, alphanumerical characters, or an icon.

12. The engine of claim 9, wherein the second threshold is a hysteresis threshold based, at least in part, on the first threshold.

13. The engine of claim 9, wherein:
- the second threshold is lower than the first threshold; and
- the third threshold is lower than the second threshold.

14. The engine of claim 9, wherein the second predefined amount of time is a fraction of the first predefined amount of time.

15. A method for determining an operational status of a pressure relief valve associated with a fuel delivery system of an engine, the method comprising:
- receiving a signal indicative of a fuel rail pressure associated with a fuel rail;
- identifying exceeding of the fuel rail pressure beyond a first threshold;
- identifying the fuel rail pressure drop below a second threshold;
- initiating a counter for a first predefined amount of time based, at least n part, on the fuel rail pressure drop below the second threshold;
- identifying if the fuel rail pressure drops below a third threshold within the first predefined amount of time;

identifying if the fuel rail pressure remains below the third threshold for at least a second predefined amount of time;

determining an open status and a closed status of the pressure relief valve based, at least in part, on the identification;

identifying a number of cycles of the open and closed status of the relief valve; and determining a maintenance interval of the relief valve, based at least in part, on the number of cycles exceeding a predefined threshold of cycles.

16. The method of claim 15 further includes limiting at least one of a speed, a power output, and a load on the engine based, at least in part, on the determination.

17. The method of claim 15 further includes:

indicating at least one of the maintenance interval or the open status of the relief valve to an operator as one or more of an alarm, alphanumerical characters, or an icon.

18. The method of claim 15, wherein the second threshold is a hysteresis threshold based, at least in part, on the first threshold.

19. The method of claim 15, wherein:

the second threshold is lower than the first threshold; and the third threshold is lower than the second threshold.

20. The method of claim 15, wherein the second predefined amount of time is a fraction of the first predefined amount of time.

* * * * *